US010600364B2

(12) United States Patent
Han

(10) Patent No.: US 10,600,364 B2
(45) Date of Patent: Mar. 24, 2020

(54) DISPLAY PANEL, PIXEL COMPENSATION CIRCUIT, AND METHOD FOR CONTROLLING THE SAME

(71) Applicants: BOE Technology Group Co., Ltd., Beijing (CN); Ordos Yuansheng Optoelectronics Co., Ltd., Ordos, Inner Mongolia (CN)

(72) Inventor: Long Han, Beijing (CN)

(73) Assignees: BOE TECHNOLOGY GROUP CO., LTD., Beijing (CN); ORDOS YUANSHENG OPTOELECTRONICS CO., LTD., Ordos, Inner Mongolia (CN)

( * ) Notice: Subject to any disclaimer, the term of this patent is extended or adjusted under 35 U.S.C. 154(b) by 0 days.

(21) Appl. No.: 16/135,714

(22) Filed: Sep. 19, 2018

(65) Prior Publication Data

US 2019/0130830 A1 May 2, 2019

(30) Foreign Application Priority Data

Nov. 1, 2017 (CN) ..... 2017 1 1059086

(51) Int. Cl.

| | |
|---|---|
| ***G09G 3/3233*** | (2016.01) |
| ***G09G 3/3241*** | (2016.01) |
| ***G09G 3/3258*** | (2016.01) |

(52) U.S. Cl.

CPC ..... *G09G 3/3241* (2013.01); *G09G 3/3233* (2013.01); *G09G 3/3258* (2013.01); *G09G 2300/0814* (2013.01); *G09G 2300/0819* (2013.01); *G09G 2310/0272* (2013.01); *G09G 2320/045* (2013.01)

(58) Field of Classification Search

CPC .... G09G 3/3241; G09G 3/325; G09G 3/3283; G09G 3/3233; G09G 3/3208; G09G 3/3225; G09G 3/3258; G09G 2320/045; G09G 2300/0819

See application file for complete search history.

(56) References Cited

U.S. PATENT DOCUMENTS

| | | | | |
|---|---|---|---|---|
| 2016/0155383 | A1* | 6/2016 | Chen | G09G 3/3233 345/211 |
| 2016/0260380 | A1* | 9/2016 | Yang | G09G 3/32 |
| 2019/0259283 | A1* | 8/2019 | Sung | B60Q 5/006 |

* cited by examiner

*Primary Examiner* — Dennis P Joseph

(74) *Attorney, Agent, or Firm* — McDermott Will & Emery LLP

(57) ABSTRACT

The present disclosure discloses a display panel, a pixel compensation circuit and a method for controlling the same. The pixel compensation circuit includes a driving transistor; a resetting circuit configured to reset the driving transistor under the control of a driving signal; a compensation circuit configured to compensate for the driving transistor; and a light-emitting control circuit configured to drive the light-emitting element to emit light under the control of a light-emitting control signal.

16 Claims, 3 Drawing Sheets

DISPLAY PANEL, PIXEL COMPENSATION CIRCUIT, AND METHOD FOR CONTROLLING THE SAME

CROSS-REFERENCE TO RELATED APPLICATION(S)

This application claims priority to the Chinese Patent Application No. CN201711059086.5, filed on Nov. 1, 2017, entitled "DISPLAY PANEL, PIXEL COMPENSATION CIRCUIT, AND METHOD FOR CONTROLLING THE SAME", which is incorporated herein by reference in its entirety.

TECHNICAL FIELD

The present disclosure relates to the field of display technologies, and more particularly, to a pixel compensation circuit, and a method for controlling the same, and a display panel.

BACKGROUND

Organic Light-Emitting Diode (OLED) displays have advantages such as high brightness, a wide viewing angle, a fast response, a low power consumption, etc., and have been widely used in high performance display fields. In these the OLED displays, Active-Matrix Organic Light-Emitting Diode (AMOLED) displays use a Low Temperature Poly-Silicon (LTPS) technology which realizes a higher mobility. However, there is a problem of drift in a threshold voltage for a Thin Film Transistor (TFT), and therefore a corresponding compensation structure is required for an OLED pixel circuit. Currently, an OLED pixel compensation circuit has a relatively complicated structure, and occupies a large area in a process of designing a layout, which is disadvantageous for design of displays with high Pixels Per Inch (PPI).

SUMMARY

According to a first aspect of the embodiments of the present disclosure, there is proposed a pixel compensation circuit, comprising: a driving transistor; a resetting circuit having one terminal coupled to a driving signal receiving terminal, and the other terminal coupled to a control terminal of the driving transistor, and configured to reset the driving transistor under the control of a driving signal, wherein the driving signal receiving terminal is configured to receive the driving signal; a compensation circuit having a first terminal coupled to a data voltage receiving terminal, a second terminal coupled to the other terminal of the resetting circuit and a control terminal of the driving transistor respectively, a third terminal coupled to a first electrode of the driving transistor, a fourth terminal coupled to a second electrode of the driving transistor, and a control terminal coupled to the driving signal receiving terminal, and configured to compensate for the driving transistor; and a light-emitting control circuit having a first terminal coupled to a first reference signal terminal, a second terminal coupled to a first electrode of a light-emitting element, a third terminal coupled to the third terminal of the compensation circuit and the first electrode of the driving transistor respectively, a fourth terminal coupled to the fourth terminal of the compensation circuit and the second electrode of the driving transistor respectively, and a control terminal coupled to the light-emitting control signal receiving terminal, and configured to drive the light-emitting element to emit light under the control of a light-emitting control signal, wherein the light-emitting control signal receiving terminal is configured to receive the light-emitting control signal.

Further, the pixel compensation circuit according to the above embodiments of the present disclosure may further have the following additional technical features.

In an embodiment of the present disclosure, the resetting circuit comprises a first capacitor having a first electrode coupled to the driving signal receiving terminal, and a second electrode coupled to the control terminal of the driving transistor.

In an embodiment of the present disclosure, the compensation circuit comprises: a first transistor having a control terminal coupled to the driving signal receiving terminal, a first electrode coupled to the data voltage receiving terminal, and a second electrode coupled to the first electrode of the driving transistor; and a second transistor having a control terminal coupled to the driving signal receiving terminal, a first electrode coupled to the control terminal of the driving transistor, and a second electrode coupled to the second electrode of the driving transistor.

In an embodiment of the present disclosure, the light-emitting control circuit comprises: a third transistor having a second electrode coupled to the first electrode of the driving transistor, a control terminal coupled to the light-emitting control signal receiving terminal, and a first electrode coupled to the first reference signal terminal; and a fourth transistor having a control terminal coupled to the light-emitting control signal receiving terminal, a first electrode coupled to the second electrode of the driving transistor, and a second electrode coupled to the first electrode of the light-emitting element.

In an embodiment of the present disclosure, the second electrode of the light-emitting element is coupled to a second reference signal terminal.

In an embodiment of the present disclosure, transistors used in the pixel compensation circuit are all P-type TFTs.

In an embodiment of the present disclosure, the light-emitting element is an OLED.

In an embodiment of the present disclosure, the resetting circuit comprises: a first capacitor having a first electrode coupled to the driving signal receiving terminal, and a second electrode coupled to the control terminal of the driving transistor; the compensation circuit comprises: a first transistor having a control terminal coupled to the driving signal receiving terminal, a first electrode coupled to the data voltage receiving terminal, and a second electrode coupled to the first electrode of the driving transistor; and a second transistor having a control terminal coupled to the driving signal receiving terminal, a first electrode coupled to the control terminal of the driving transistor, and a second electrode coupled to the second electrode of the driving transistor; and the light-emitting control circuit comprises: a third transistor having a second electrode coupled to the first electrode of the driving transistor, a control terminal coupled to the light-emitting control signal receiving terminal, and a first electrode coupled to the first reference signal terminal; and a fourth transistor having a control terminal coupled to the light-emitting control signal receiving terminal, a first electrode coupled to the second electrode of the driving transistor, and a second electrode coupled to the first electrode of the light-emitting element.

Based on the pixel compensation circuit according to the above embodiments, according to a second aspect of the embodiments of the present disclosure, there is proposed a method for controlling the pixel compensation circuit described above, the method comprising steps of: in an initialization phase, generating, by the resetting circuit, an initialization signal according to a driving signal, and transferring the initialization signal to the control terminal of the driving transistor to reset the driving transistor; in a data writing and compensation phase, turning on the compensation circuit under the control of the driving signal, and sequentially transferring, by the compensation circuit, a data voltage signal to the first electrode of the driving transistor and one terminal of the resetting circuit, thereby generating a compensation signal under the action of the data voltage signal through the resetting circuit to compensate for the driving transistor and writing a compensation voltage into the resetting circuit; and in a light-emitting phase, turning on the light-emitting control circuit under the control of the light-emitting control signal, transferring, by the light-emitting control circuit, a first reference signal to the first electrode of the driving transistor, turning on the driving transistor under the control of the compensation voltage, outputting, by the driving transistor, driving current under the action of the first reference voltage, and driving, by the light-emitting control circuit, the light-emitting element to emit light according to the driving current.

Further, the method for controlling the pixel compensation circuit according to the above embodiments of the present disclosure may further have the following additional technical features.

In an embodiment of the present disclosure, the driving current output by the driving transistor is calculated according to the following equation:

$$I_{on} = \frac{\mu W C_{ox}}{2L} \times (VDD - V_{data})^2$$

wherein $I_{on}$ is the driving current, μ is a mobility of the driving transistor, W is the channel width of the driving transistor, $C_{ox}$ is the oxidation capacitance at the control terminal of the driving transistor, L is the channel length of the driving transistor, VDD is the first reference signal voltage, and Vdata is the data voltage.

According to a third aspect of the embodiments of the present disclosure, there is proposed a display panel comprising the pixel compensation circuit described above.

According to a fourth aspect of the embodiments of the present disclosure, there is proposed a touch display comprising the display panel described above.

BRIEF DESCRIPTION OF THE ACCOMPANYING DRAWINGS

The accompanying drawings are used to provide a further understanding of the technical solutions of the present disclosure, and constitute a part of the specification. The accompanying drawings are used to explain the technical solutions of the present disclosure together with the embodiments of the present application, and do not constitute a limitation on the technical solutions of the present disclosure.

DETAILED DESCRIPTION

The embodiments of the present disclosure will be described in detail below, and examples of the embodiments are illustrated in the accompanying drawings, wherein the same or similar reference signs are used to refer to the same or similar elements or elements having the same or similar functions. The embodiments described below with reference to the accompanying drawings are intended to explain the present disclosure, and are not to be construed as limiting the present disclosure.

The pixel compensation circuit and the display panel according to the embodiments of the present disclosure will be described below with reference to the accompanying drawings.

Figure 1:
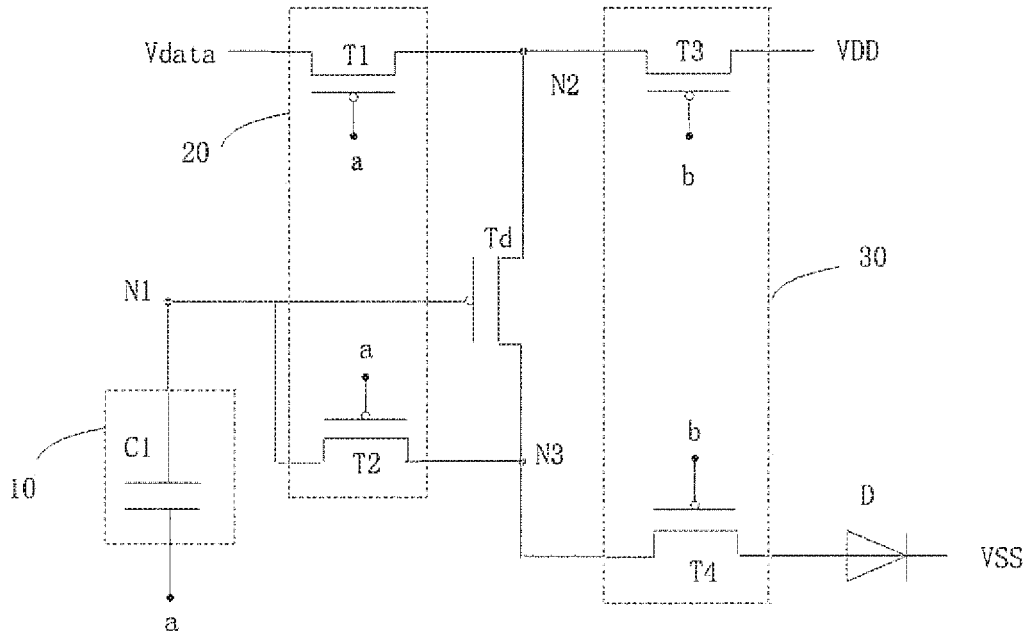
FIG. 1 is an exemplary diagram of a pixel compensation circuit according to an embodiment of the present disclosure.

FIG. 1 is a diagram of a pixel compensation circuit according to an embodiment of the present disclosure. As shown in FIG. 1, the pixel compensation circuit comprises a driving transistor Td, a resetting circuit 10, a compensation circuit 20, and a light-emitting control circuit 30.

Here, as shown in FIG. 1, a driving signal receiving terminal a is configured to receive a driving signal Gate, i.e., a scanning signal; a light-emitting control signal receiving terminal b is configured to receive a light-emitting control signal EM. Further, the resetting circuit 10 has one terminal coupled to the driving signal receiving terminal a, and the other terminal coupled to a control terminal of the driving transistor Td, and the resetting circuit 10 is configured to reset the driving transistor Td under the control of the driving signal; the compensation circuit 20 has a first terminal coupled to a data voltage receiving terminal, a second terminal coupled to the other terminal of the resetting circuit 10 and a control terminal of the driving transistor Td, respectively, a third terminal coupled to a first electrode of the driving transistor Td, a fourth terminal coupled to a second electrode of the driving transistor Td, and a control terminal coupled to the driving signal receiving terminal a, and the compensation circuit 20 is configured to compensate for the driving transistor Td; and the light-emitting control circuit 30 has a first terminal coupled to a first reference signal terminal, a second terminal coupled to a first electrode of a light-emitting element D, a third terminal coupled to the third terminal of the compensation circuit 20 and the first electrode of the driving transistor Td, respectively, a fourth terminal coupled to the fourth terminal of the compensation circuit 20 and the second electrode of the driving transistor Td, respectively, and a control terminal coupled to the light-emitting control signal receiving terminal b, and the light-emitting control circuit 30 is configured to drive the light-emitting element D to emit light under the control of the light-emitting control signal EM.

Optionally, the light-emitting element D may be an OLED.

In an embodiment of the present disclosure, as shown in FIG. 1, the resetting circuit 10 comprises a first capacitor C1. Here, the first capacitor C1 has a first electrode coupled to the driving signal receiving terminal a, and a second electrode coupled to the control terminal of the driving transistor Td and forming a first node N1.

The compensation circuit 20 comprises a first transistor T1 and a second transistor T2. Here, the first transistor T1 has a control terminal coupled to the driving signal receiving terminal a, a first electrode acting as a data voltage receiving terminal to receive a data voltage signal Vdata, and a second electrode coupled to the first electrode of the driving transistor Td and forming a second node N2. The second transistor T2 has a control terminal coupled to the driving signal receiving terminal a, a first electrode coupled to the first node N1, and a second electrode coupled to the second electrode of the driving transistor Td and forming a third node N3.

The light-emitting control circuit 30 comprises a third transistor T3 and a fourth transistor T4. Here, the third transistor T3 has a second electrode coupled to the second node N2, a control terminal coupled to the light-emitting control signal receiving terminal b, and a first electrode coupled to the first reference signal terminal to receive a preset power supply signal VDD. The fourth transistor T4 has a control terminal coupled to the light-emitting control signal receiving terminal b, a first electrode coupled to the third node N3, and a second electrode coupled to an anode of the light-emitting element D. Further, a cathode of the light-emitting element D is coupled to a second reference signal terminal, such as a reference ground VSS.

Optionally, types of the first transistor T1, the second transistor T2, the third transistor T3, the fourth transistor T4, and the driving transistor Td may be selected as needed, and a circuit connection thereof may be set according to the selected types of the transistors.

In an embodiment of the present disclosure, the first transistor T1, the second transistor T2, the third transistor T3, the fourth transistor T4, and the driving transistor Td are all P-type TFTs, wherein the first transistor T1, the second transistor T2, the third transistor T3 and the fourth transistor T4 are all switching TFTs, and the driving transistor Td is a driving TFT.

Figure 2:
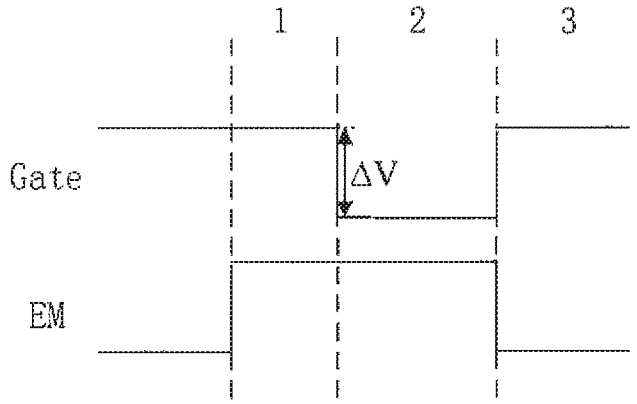
FIG. 2 is an exemplary operational timing diagram of a pixel compensation circuit according to an embodiment of the present disclosure.

Further, an operating principle of the pixel compensation circuit according to the embodiment of the present disclosure may be described in conjunction with operation timings of the driving signal and the light-emitting control signal shown in FIG. 2.

Specifically, in a first phase (i.e., an initialization phase), the driving signal Gate is coupled to the first electrode of the first capacitor C1 through the driving signal receiving terminal a, and when the driving signal Gate transitions from a high level to a low level, a voltage change has an amplitude of ΔV. As the first capacitor C1 is suspended, in order to keep a voltage drop across the first capacitor C1 unchanged, an amplitude of a voltage change at the first node N1 is the same as an amplitude of a potential change at the driving signal receiving terminal a, that is, the changed potential at the first node N1 is at a low level. In this phase, resetting and initialization of the driving transistor Td are completed, and the driving transistor Td changes from a turn-off state to a turn-on state. It should be illustrated that in this embodiment, ΔV is a positive value.

Figure 3:
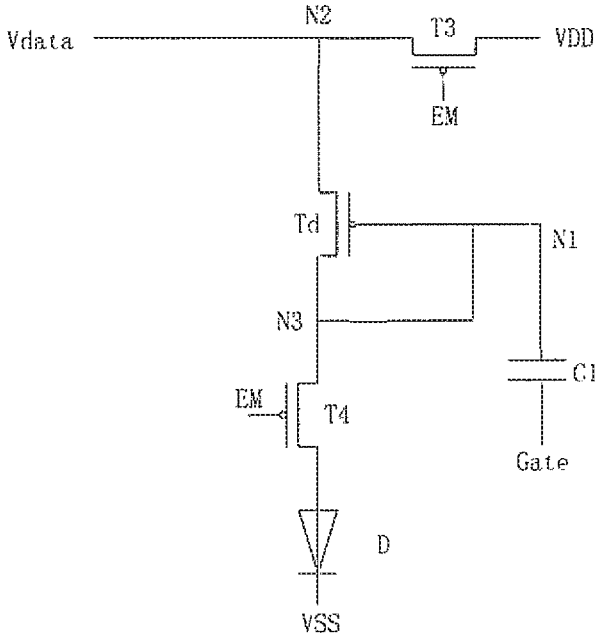
FIG. 3 is an exemplary equivalent circuit diagram of a pixel compensation circuit in a sampling compensation phase according to an embodiment of the present disclosure.

In a second phase (i.e., a data writing and compensation phase), the driving signal Gate is at a low level, and the light-emitting control signal EM is at a high level. In this case, the first transistor T1 and the second transistor T2 are turned on, and the third transistor T3 and the fourth transistor T4 are turned off. A potential at the second node N2 changes to Vdata. The potential at the first node N1 changes to Vdata+Vth, the driving transistor Td changes from the turn-on state to the turn-off state, and the data voltage signal Vdata compensates for a threshold voltage Vth of the driving transistor Td under the coupling action of the first capacitor C1, where Vth is a positive value. In this phase, an equivalent circuit may be known with reference to FIG. 3.

Figure 4:
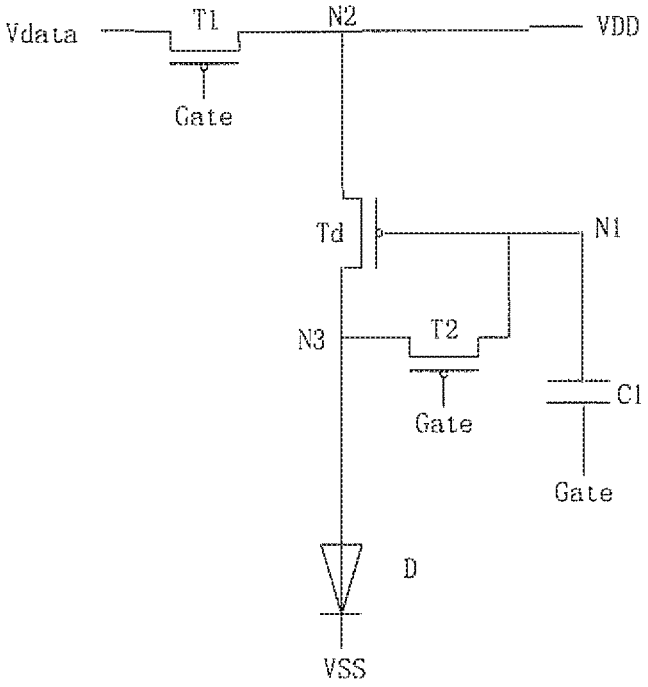
FIG. 4 is an exemplary equivalent circuit diagram of a pixel compensation circuit in a light-emitting phase according to an embodiment of the present disclosure.

In a third phase (i.e., a light-emitting phase), the light-emitting control signal EM is at a low level, and the driving signal Gate is at a high level. In this case, the first transistor T1 and the second transistor T2 are turned off, and the third transistor T3 and the fourth transistor T4 are turned on. The potential at the second node N2 becomes a voltage VDD at the first reference signal terminal, which is at a high level, the driving transistor Td outputs driving current, and VSS is at a low level, so that the light-emitting element D emits light. In this phase, an equivalent circuit may be known with reference to FIG. 4.

In the embodiment of the present disclosure, in the third phase described above, the current of the light-emitting element D, i.e., the driving current output from the driving transistor, may be calculated by the following equation (1):

$$\begin{aligned} I_{on} &= \frac{\mu W C_{ox}}{2L} \times (V_{gs} - |V_{th}|)^2 \\ &= \frac{\mu W C_{ox}}{2L} \times (V_{data} + V_{th} - VDD - |V_{th}|)^2 \\ &= \frac{\mu W C_{ox}}{2L} \times (VDD - V_{data})^2 \end{aligned} \quad (1)$$

wherein, $I_{on}$ is the driving current, μ is a mobility of the driving transistor Td, W is a channel width of the driving transistor Td, $C_{ox}$ is capacitance per unit area of an insulating layer at the control terminal of the driving transistor Td, and L is a channel length of the driving transistor Td.

Therefore, only 5 TFTs are required for the pixel compensation circuit to realize compensation for the threshold voltage Vth of the driving transistor Td, and there is a small number of signal lines, which is advantageous for design of a display product with high PPI.

It should be illustrated that a control terminal of each of the transistors T1 to T4 and Td is a gate, and for a first electrode and a second electrode of each of the transistors T1 to T4 and Td, the first electrode may be defined as a source and the second electrode may be defined as a drain, or the first electrode may be defined as a drain and the second electrode may be defined as a source.

In summary, according to the pixel compensation circuit according to the embodiments of the present disclosure, the driving transistor is reset by the resetting circuit under the control of the driving signal in the initialization phase, the driving transistor is compensated by the compensation circuit in the data writing and compensation phase, and then the light-emitting diode is driven by the light-emitting control circuit to emit light under the control of the light-emitting control signal in the light-emitting phase, thereby eliminating the influence of a threshold voltage difference among different pixels on uniformity of display brightness, and the circuit has a simple structure, which is advantageous for realizing design of a display product with high PPI.

Based on the pixel compensation circuit according to the above embodiments, the operating principle is described by taking the transistors T1 to T4 and Td being all P-type transistors (i.e., the transistors are turned on at a low level, and are turned off at a high level) as an example. The present disclosure proposes a method for controlling the pixel compensation circuit, which comprises the following steps.

In S101, i.e., an initialization phase in which the driving signal is at a high level and the light-emitting control signal is at a high level, an initialization signal is generated by the resetting circuit according to the driving signal, and the initialization signal is transferred by the resetting circuit to the control terminal of the driving transistor to reset the driving transistor.

In S102, i.e., a data writing and compensation phase in which the driving signal is at a low level and the light-emitting control signal is at a high level, the compensation circuit is turned on under the control of the driving signal, and sequentially transfers a data voltage signal to the first electrode of the driving transistor and one terminal of the resetting circuit to generate a compensation signal under the action of the data voltage signal through the resetting circuit to compensate for the driving transistor, and write a compensation voltage of the driving transistor into the resetting circuit.

In S103, i.e., a light-emitting phase in which the driving signal is at a high level and the light-emitting control signal is at a low level, the light-emitting control circuit is turned on under the control of the light-emitting control signal, and transfers a first reference signal to the first electrode of the driving transistor, the driving transistor is turned on under the control of the compensation voltage, and outputs driving current under the action of the first reference voltage, and the light-emitting element is driven by the light-emitting control circuit to emit light according to the driving current.

According to an embodiment of the present disclosure, the driving current output by the driving transistor is calculated according to the following equation (1):

$$I_{on} = \frac{\mu W C_{ox}}{2L} \times (VDD - V_{data})^2 \quad (1)$$

wherein, $I_{on}$ is the driving current, μ is the mobility of the driving transistor, W is the channel width of the driving transistor, $C_{ox}$ is the oxidation capacitance at the control terminal of the driving transistor, and L is the channel length of the driving transistor.

According to the method for controlling a pixel compensation circuit according to the embodiment of the present disclosure, the driving transistor is reset by the resetting circuit under the control of the driving signal in the initialization phase, the driving transistor is compensated by the compensation circuit in the data writing and compensation phase, and then the light-emitting diode is driven by the light-emitting control circuit to emit light under the control of the light-emitting control signal in the light-emitting phase, thereby eliminating the influence of a threshold voltage difference among different pixels on uniformity of display brightness, and the circuit has a simple structure, which is advantageous for realizing design of a display product with high PPI.

Figure 5:
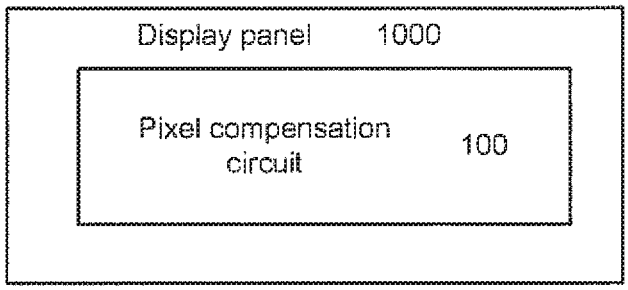
FIG. 5 is an exemplary block diagram of a display panel according to an embodiment of the present disclosure.

FIG. 5 is a block diagram of a display panel according to an embodiment of the present disclosure. As shown in FIG. 5, the display panel 1000 comprises the pixel compensation circuit 100 according to the embodiments of the present disclosure described above.

The display panel according to the embodiment of the present disclosure adopts the above pixel compensation circuit, which can eliminate the influence of a threshold voltage difference among different pixels on uniformity of display brightness, and the compensation circuit has a simple structure, which is advantageous for realizing design of the display panel with high PPI.

Further, the present disclosure further proposes a touch display.

Figure 6:
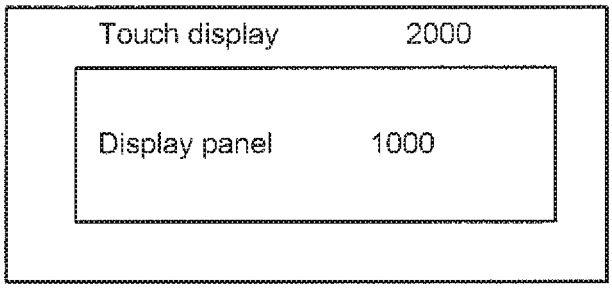
FIG. 6 is an exemplary block diagram of a touch display according to an embodiment of the present disclosure.

FIG. 6 is a block diagram of a touch display according to an embodiment of the present disclosure. As shown in FIG. 6, the touch display 2000 comprises the display panel 1000 according to the embodiment of the present disclosure described above.

The touch display according to the embodiment of the present disclosure adopts the display panel described above, which can eliminate the influence of a threshold voltage difference among different pixels on uniformity of display brightness, and can realize design of the touch display with high PPI.

In the description of the present disclosure, it is to be understood that an orientation or positional relationship indicated by terms "center", "longitudinal", "transverse", "length", "width", "thickness", "upper", "lower", "front", "back", "left", "right", "vertical", "horizontal", "top", "bottom", "inside", "outside", "clockwise", "counterclockwise", "axial", "radial", "circumferential" etc. is an orientation or positional relationship based on the accompanying drawings, and is merely for the convenience of describing the present disclosure and simplifying the description, does not indicate or imply that the indicated apparatus or element must have a specific orientation, or must be constructed and operated in a particular orientation, and is not to be construed as limiting the present disclosure.

Further, terms "first" and "second" are used for descriptive purposes only and are not to be construed as indicating or implying a relative importance or implicitly indicating a number of technical features indicated. Thus, features defined by "first" or "second" may comprise at least one feature, either explicitly or implicitly. In the description of the present disclosure, "multiple" means at least two, for example, two, three, etc., unless specifically defined otherwise.

In the description of the present disclosure, it should be illustrated that terms "install", "coupled with", "coupled to", "fixed" etc. should be understood in a broad sense unless explicitly specified or defined otherwise, and may be, for example, a fixed connection, a removable connection, or an integral connection; or may be a mechanical connection or an electrical connection; or may be a direct connection or an indirect connection through an intermediary; or may be internal communication between two elements or interaction between two elements, unless otherwise explicitly defined. Those of ordinary skill in the art can understand specific meanings of the above terms in the present disclosure according to specific conditions.

In the present disclosure, a first feature being located "on" or "under" a second feature may mean that the first feature is in direct contact with the second feature, or the first feature is in indirect contact with the second feature through an intermediary, unless otherwise explicitly stated and defined. Further, the first feature being located "above", "on" and "over" the second feature may mean that the first feature is directly above or obliquely above the second feature, or merely means that the first feature has a horizontal level higher than that of the second feature. The first feature being located "below", "under" and "beneath" the second feature may mean that the first feature is directly below or obliquely below the second feature, or merely means that the first feature level has a horizontal level lower than that of the second feature.

In the description of the present specification, the description with reference to terms "one embodiment", "some embodiments", "example", "specific example", or "some examples" etc. means that specific features, structures, materials, or characteristics described in connection with the embodiment or example are included in at least one embodiment or example of the present disclosure. In the present specification, the schematic expression of the above terms is not necessarily directed to the same embodiment or example. Further, the specific features, structures, materials, or characteristics described may be combined in a suitable manner in any one or more embodiments or examples. In addition, different embodiments or examples described in the specification as well as features in the different embodiments or examples may be integrated and combined by those skilled in the art without a conflict.

Although the embodiments of the present disclosure have been shown and described above, it can be understood that the embodiments described above are illustrative and are not to be construed as limiting the present disclosure. Changes, modifications, substitutions and variations can be made to the above embodiments by those of ordinary skill in the art within the scope of the present disclosure.

I claim:

1. A pixel compensation circuit, comprising:

a driving transistor;

a resetting circuit having one terminal coupled to a driving signal receiving terminal, and another terminal coupled to a control terminal of the driving transistor, and configured to reset the driving transistor under control of a driving signal, wherein the driving signal receiving terminal is configured to receive the driving signal;

a compensation circuit having a first terminal coupled to a data voltage receiving terminal, a second terminal coupled to the other terminal of the resetting circuit and a control terminal of the driving transistor, respectively, a third terminal coupled to a first electrode of the driving transistor, a fourth terminal coupled to a second electrode of the driving transistor, and a control terminal coupled to the driving signal receiving terminal, and configured to compensate for the driving transistor; and a light-emitting control circuit having a first terminal coupled to a first reference signal terminal, a second terminal coupled to a first electrode of a light-emitting element, a third terminal coupled to the third terminal of the compensation circuit and the first electrode of the driving transistor, respectively, a fourth terminal coupled to the fourth terminal of the compensation circuit and the second electrode of the driving transistor, respectively, and a control terminal coupled to a light-emitting control signal receiving terminal, and configured to drive the light-emitting element to emit light under control of a light-emitting control signal, wherein the light-emitting control signal receiving terminal is configured to receive the light-emitting control signal.

2. The pixel compensation circuit according to claim 1, wherein the resetting circuit comprises: a first capacitor having a first electrode coupled to the driving signal receiving terminal, and a second electrode coupled to the control terminal of the driving transistor.

3. The pixel compensation circuit according to claim 1, wherein the compensation circuit comprises:

a first transistor having a control terminal coupled to the driving signal receiving terminal, a first electrode coupled to the data voltage receiving terminal, and a second electrode coupled to the first electrode of the driving transistor; and a second transistor having a control terminal coupled to the driving signal receiving terminal, a first electrode coupled to the control terminal of the driving transistor, and a second electrode coupled to the second electrode of the driving transistor.

4. The pixel compensation circuit according to claim 1, wherein the light-emitting control circuit comprises:

a third transistor having a second electrode coupled to the first electrode of the driving transistor, a control terminal coupled to the light-emitting control signal receiving terminal, and a first electrode coupled to the first reference signal terminal; and a fourth transistor having a control terminal coupled to the light-emitting control signal receiving terminal, a first electrode coupled to the second electrode of the driving transistor, and a second electrode coupled to the first electrode of the light-emitting element.

5. The pixel compensation circuit according to claim 1, wherein the second electrode of the light-emitting element is coupled to a second reference signal terminal.

6. The pixel compensation circuit according to claim 1, wherein transistors used in the pixel compensation circuit are all P-type Thin Film Transistors.

7. The pixel compensation circuit according to claim 1, wherein the light-emitting element is an Organic Light-emitting Diode.

8. The pixel compensation circuit according to claim 1, wherein the resetting circuit comprises:

a first capacitor having a first electrode coupled to the driving signal receiving terminal, and a second electrode coupled to the control terminal of the driving transistor;

the compensation circuit comprises:

a first transistor having a control terminal coupled to the driving signal receiving terminal, a first electrode coupled to the data voltage receiving terminal, and a second electrode coupled to the first electrode of the driving transistor; and a second transistor having a control terminal coupled to the driving signal receiving terminal, a first electrode coupled to the control terminal of the driving transistor, and a second electrode coupled to the second electrode of the driving transistor; and the light-emitting control circuit comprises:

a third transistor having a second electrode coupled to the first electrode of the driving transistor, a control terminal coupled to the light-emitting control signal receiving terminal, and a first electrode coupled to the first reference signal terminal; and a fourth transistor having a control terminal coupled to the light-emitting control signal receiving terminal, a first electrode coupled to the second electrode of the driving transistor, and a second electrode coupled to the first electrode of the light-emitting element.

9. A display panel comprising the pixel compensation circuit according to claim 1.

10. A touch display comprising the display panel according to claim 9.

11. A method for controlling a pixel compensation circuit, wherein the pixel compensation circuit comprises:

a driving transistor;

a resetting circuit having one terminal coupled to a driving signal receiving terminal, and another terminal coupled to a control terminal of the driving transistor, and configured to reset the driving transistor under control of a driving signal, wherein the driving signal receiving terminal is configured to receive the driving signal;

a compensation circuit having a first terminal coupled to a data voltage receiving terminal, a second terminal coupled to the other terminal of the resetting circuit and a control terminal of the driving transistor, respectively, a third terminal coupled to a first electrode of the driving transistor, a fourth terminal coupled to a second electrode of the driving transistor, and a control terminal coupled to the driving signal receiving terminal, and configured to compensate for the driving transistor; and a light-emitting control circuit having a first terminal coupled to a first reference signal terminal, a second terminal coupled to a first electrode of a light-emitting element, a third terminal coupled to the third terminal of the compensation circuit and the first electrode of the driving transistor, respectively, a fourth terminal coupled to the fourth terminal of the compensation circuit and the second electrode of the driving transistor, respectively, and a control terminal coupled to a light-emitting control signal receiving terminal, and configured to drive the light-emitting element to emit light under control of a light-emitting control signal, wherein the light-emitting control signal receiving terminal is configured to receive the light-emitting control signal, the method comprising steps of:

in an initialization phase, generating, by the resetting circuit, an initialization signal according to a driving signal, and transferring the initialization signal to the control terminal of the driving transistor to reset the driving transistor;

in a data writing and compensation phase, turning on the compensation circuit under the control of the driving signal, and sequentially transferring, by the compensation circuit, a data voltage signal to the first electrode of the driving transistor and one terminal of the resetting circuit, thereby generating a compensation signal under the action of the data voltage signal through the resetting circuit to compensate for the driving transistor and writing a compensation voltage into the resetting circuit; and in a light-emitting phase, turning on the light-emitting control circuit under the control of the light-emitting control signal, transferring, by the light-emitting control circuit, a first reference signal to the first electrode of the driving transistor, turning on the driving transistor under the control of the compensation voltage, outputting, by the driving transistor, driving current under the action of the first reference voltage, and driving, by the light-emitting control circuit, the light-emitting element to emit light according to the driving current.

12. The method according to claim 11, wherein the resetting circuit comprises: a first capacitor having a first electrode coupled to the driving signal receiving terminal, and a second electrode coupled to the control terminal of the driving transistor.

13. The method according to claim 11, wherein the compensation circuit comprises:

a first transistor having a control terminal coupled to the driving signal receiving terminal, a first electrode coupled to the data voltage receiving terminal, and a second electrode coupled to the first electrode of the driving transistor; and a second transistor having a control terminal coupled to the driving signal receiving terminal, a first electrode coupled to the control terminal of the driving transistor, and a second electrode coupled to the second electrode of the driving transistor.

14. The method according to claim 11, wherein the light-emitting control circuit comprises:

a third transistor having a second electrode coupled to the first electrode of the driving transistor, a control terminal coupled to the light-emitting control signal receiving terminal, and a first electrode coupled to the first reference signal terminal; and a fourth transistor having a control terminal coupled to the light-emitting control signal receiving terminal, a first electrode coupled to the second electrode of the driving transistor, and a second electrode coupled to the first electrode of the light-emitting element.

15. The method according to claim 11, wherein the second electrode of the light-emitting element is coupled to a second reference signal terminal.

16. The method according to claim 11, wherein the driving current output by the driving transistor is calculated according to the following equation:

$$I_{on} = \frac{\mu W C_{ox}}{2L} \times (VDD - V_{data})^2$$

wherein $I_{on}$ is the driving current, μ is a mobility of the driving transistor, W is the channel width of the driving transistor, $C_{ox}$ is the oxidation capacitance at the control terminal of the driving transistor, L is the channel length of the driving transistor, VDD is the first reference signal voltage, and Vdata is the data voltage.

* * * * *